US005692576A

United States Patent [19]

Hesse et al.

[11] Patent Number: 5,692,576

[45] Date of Patent: Dec. 2, 1997

[54] LOCATING DEVICE FOR PERCUSSION BORING MACHINES

[75] Inventors: Alfons Hesse; Joachim Schmidt, both of Lennestadt, Germany

[73] Assignee: Tracto -Technik Paul Schmidt Spezialmaschinen KG, Lennestadt, Germany

[21] Appl. No.: 547,956

[22] Filed: Oct. 25, 1995

[30] Foreign Application Priority Data

Oct. 31, 1994 [DE] Germany ..... 44 38 934.5

[51] Int. Cl.[6] ..... E21B 4/14; E21B 47/09

[52] U.S. Cl. ..... 175/45; 175/19

[58] Field of Search ..... 175/45, 40, 19

[56] References Cited

U.S. PATENT DOCUMENTS

| | | | |
|---|---|---|---|
| 2,255,721 | 9/1941 | Mattingly et al. | 175/45 |
| 3,746,106 | 7/1973 | McCullough et al. | 175/45 |
| 4,854,398 | 8/1989 | Holloway | 175/45 |
| 4,875,292 | 10/1989 | Gibson | 33/304 |
| 4,907,658 | 3/1990 | Stangl et al. | 175/45 |
| 5,002,137 | 3/1991 | Dickinson et al. | 175/19 |
| 5,248,857 | 9/1993 | Ollivier | 175/40 |
| 5,322,391 | 6/1994 | Fisk | 175/73 |
| 5,490,569 | 2/1996 | Brotherton et al. | 175/61 |

FOREIGN PATENT DOCUMENTS

| | | | |
|---|---|---|---|
| 428180 | 5/1991 | European Pat. Off. | 175/45 |
| 243381 | 10/1986 | Japan | 175/40 |
| 2214539 | 9/1989 | United Kingdom . | |
| PCT/GB86/00780 | 7/1987 | WIPO . | |
| WO87/03924 | 7/1987 | WIPO . | |

*Primary Examiner*—Hoang C. Dang

*Attorney, Agent, or Firm*—Bell Seltzer Intellectual Property Group of Alston & Bird LLC

[57] ABSTRACT

The invention relates to a device for locating percussion boring machines using a transmitter and a receiver which allows the radio transmitter to be connected to the percussion boring machine in a simple manner and preferably without breaking the connection between the compressed air line and the percussion boring machine; which does not hinder the manoeuvrability of the hammer drill; which is less susceptible to mechanical influences during the boring; and which can easily be disassembled. This is achieved by fastening a housing with a receptacle for the transmitter or the receiver on a fluid line.

20 Claims, 1 Drawing Sheet

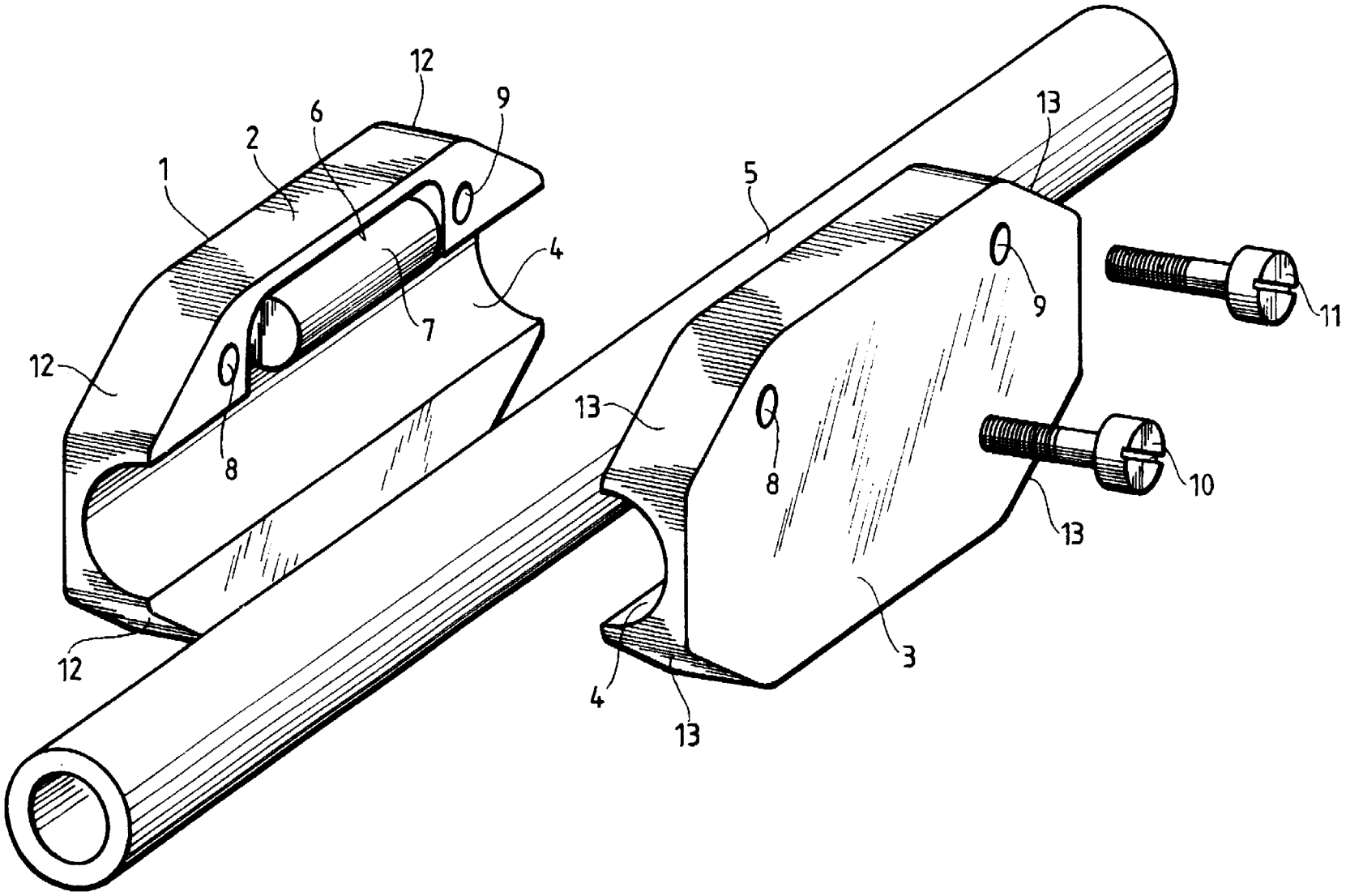
11
10
13
9
3
8
5
13
4
13
4
9
12
7
6
2
8
1
12
12

LOCATING DEVICE FOR PERCUSSION BORING MACHINES

FIELD OF THE INVENTION

The invention relates to a device for locating percussion boring machines of the kind used for laying underground service lines without excavation or for the destructive replacement of existing underground service lines. Such percussion boring machines, also known as earth displacement hammers or moles, move independently through the ground under the influence of a pneumatically or hydraulically driven striking piston and are connected by a pipeline to an above-ground supply of pressure medium.

BACKGROUND OF THE INVENTION AND PRIOR ART

A particular problem in the case of such machines is to determine their position in the ground, so as to be able, if necessary, to take steps to control them or to dig out a machine that is stuck in the ground. This is usually done by the use of a transmitter/receiver system, which, however, necessitates fitting either the transmitter or the receiver in or on the percussion boring machine.

There have been a whole series of proposals for doing this. Thus in the case of a percussion boring machine disclosed in the published PCT application 87/03 924 a locating device is fitted inside the percussion boring machine which transmits a signal and thus makes it possible to locate the percussion boring machine. The signal is conducted to the exterior through a cable from the locating device or the percussion boring machine.

This known locating device has the disadvantage that its position inside the percussion boring machine makes maintenance or exchange of a defective locating device difficult: in order to instal or exchange the locating device, the percussion boring machine must first be dismantled. This is particularly serious since the locating device is very highly stressed by the impact forces that arise in the percussion boring machine, and this high stressing leads to increased likelihood of failure of the locating device.

In contrast to this, German Utility Model 88 04 347 proposes a device with a radio transmitter for the location of percussion boring machines. In this device a cylindrical housing is connected to a compressed air line through an end adaptor and to the percussion boring machine through a second end adaptor. The radio transmitter is disposed inside the housing in the flow path of the compressed air, and the compressed air flows round it. Thus the housing of the locating device is an integral part of the compressed air line, but is so constructed that it can accommodate a transmitter. This requires a pressure-tight probe housing.

To fit the locating device, the compressed air hose must be disconnected from the percussion boring machine and then connected to the locating device and the latter attached to the percussion boring machine.

The position of the locating device and hence of the percussion boring machine can be determined from the surface by radio with the aid of a receiver.

The housing of the locating device, in contrast to the compressed air line, constitutes a rigid body. If, now, the locating device is disposed between the percussion boring machine and the compressed air line, the rigid percussion boring machine is lengthened by a corresponding amount. This leads to a reduction in the manoeuvrability of the percussion boring machine and requires a correspondingly enlarged construction or starting pit.

Because of the hose connection that is required the locating device cannot be used just as it is for any hose or for any percussion boring machine. Moreover, at the point of connection between the percussion boring machine and the locating device a breaking point is formed which is particularly highly stressed by the greater lever effect. Furthermore the narrowing of the cross-section in the flow path of the compressed air leads to disadvantageous turbulence.

OBJECT OF THE INVENTION

Accordingly it is an object of the invention to provide a locating device which makes possible a simple connection of the radio transmitter to the percussion boring machine preferably without breaking the connection between the compressed air line and the boring machine, which does not hinder the manoeuvrability of the hammer drill, which is less susceptible to mechanical influences and which can easily be removed.

SUMMARY OF THE INVENTION

The invention is based on the idea of positioning the radio transmitter in a simple manner externally, instead of integrating it into the compressed air line or the boring machine itself, as in known locating devices.

This idea is realized by providing a housing for the radio transmitter or the receiver which has fastening means enabling the housing to be connected to the pressure medium line. Preferably the housing embraces the pressure medium line by means of two parts, one of which accommodates the radio transmitter or receiver.

The part of the housing which receives the radio transmitter then has a recess for the radio transmitter and at least two points of connection for the second part of the housing. The housing can be flattened or bevelled in the front or rear region in order not to hinder the progress of the percussion boring machine and to keep down the stress on the housing due to the ground.

To use a percussion boring machine with the locating device of the invention, it is only necessary to place a conventional radio transmitter in the recess in the housing, to fit the two halves of the housing around the pressure medium line and to connect them together.

The housing in accordance with the invention makes it possible to use any desired radio transmitter or receiver, even without adaptation of the recess in the housing of the locating device, provided only that this recess is large enough. Moreover a radio transmitter that is available can be used with any desired percussion boring machine, independently of the size of the hose or hose coupling. It can be fitted in any desired position, immediately behind or at any desired distance from the percussion boring machine. Because of the simple and compact construction of the housing, it may be made of plastics material. In contrast to known locating devices, in the case of the piggy-back transmitter in accordance with the invention a pressure-tight housing is not necessary. This leads to a considerable reduction in the cost of manufacture.

The piggy-back transmitter has no effect of any kind on the pressure medium line, and thus it avoids both narrowing of the cross-section of the pressure line and the occurrence of turbulence.

The invention will now be described in more detail, by way of example, with reference to an embodiment of the housing of the invention which is shown in the accompanying drawing.

BRIEF DESCRIPTION OF THE DRAWING

The drawing shows an exploded perspective view of a two-part housing for a radio transmitter in accordance with the invention, embracing a pressure medium line.

DETAILED DESCRIPTION OF AN EMBODIMENT OF THE INVENTION

The housing 1 consists of a part 2 accommodating the radio transmitter and a complementary part 3. The parts of the housing have a central bore 4 which embraces one or more fluid lines 5 leading to a percussion boring machine (not shown). The housing part 2 carrying the transmitter has a recess 6 in which a radio transmitter 7 is placed. Both parts 2, 3 of the housing have bores 9, 8, in which bolts 10 and 11 are fitted to lock them together. At their front and rear ends both parts of the housing have slopes or bevels 12, 13 which substantially complement one another to form one part. These bevels or flattened portions prevent the housing from getting caught on stones, roots or other solid objects as it advances. In any case, the risk of getting caught is very small, since the diameter of the compressed air line is substantially smaller than the diameter of the percussion boring machine and the diameter of the passage through the ground that is determined by the boring machine, so that enough room is left even for relatively large housings. What is more, in many cases pipes are pulled along directly behind the boring machine.

When fitting the locating device on the compressed air line the radio transmitter 7 is first placed in the recess 6. The two halves of the housing are then placed round the line and are connected by means of the bolts 10 and 11. In this way any percussion boring machine can be fitted with a locating system just as it is, without the compressed air supply being impaired. The cost of the housing is minimal, and moreover only a few housings and transmitters are needed for a large range of percussion boring machines, whereas in the case of fixed housing systems each of the percussion boring machines requires a receiver or transmitter of its own.

What is claimed is:

1. An apparatus for locating a percussion boring machine having a fluid line extending therefrom, the apparatus comprising:

a housing defining a receptacle therein, said housing comprising fastening means for mounting said housing to the fluid line such that the fluid line extends unbroken through at least a portion of said housing and such that said housing is maintained in a predetermined fixed relationship to the fluid line and to the percussion boring machine from which the fluid line extends; and a transmitter, disposed within the receptacle defined by said housing, for transmitting signals indicative of the location of the percussion boring machine.

2. An apparatus according to claim 1 wherein said fastening means comprises a lengthwise extending aperture defined by said housing and through which the fluid line extends.

3. An apparatus according to claim 2 wherein said lengthwise extending aperture extends through a central portion of said housing, and wherein the receptacle is defined by a lateral portion of said housing.

4. An apparatus according to claim 2 wherein said housing comprises first and second housing portions, and wherein said first and second housing portions define respective, complimentary portions of the lengthwise extending aperture through which the fluid line extends.

5. An apparatus according to claim 4 further comprising at least one connector for interconnecting said first and second housing portions.

6. An apparatus according to claim 5 wherein said at least one connector comprises at least one bolt.

7. An apparatus according to claim 1 wherein said housing further comprises beveled end portions for facilitating advancement of the percussion boring machine through the ground.

8. An apparatus for locating a percussion boring machine having a fluid line extending therefrom, the apparatus comprising:

a housing defining a receptacle therein, said housing further defining a lengthwise extending aperture for receiving and engaging the fluid line such that the fluid line extends unbroken therethrough, said housing being mounted in a predetermined fixed relationship to the fluid line and to the percussion boring machine from which the fluid line extends; and a transmitter, disposed within the receptacle defined by said housing, for transmitting signals indicative of the location of the percussion boring machine.

9. An apparatus according to claim 8 wherein said lengthwise extending aperture is defined by a central portion of said housing, and wherein the receptacle is defined by a lateral portion of said housing.

10. An apparatus according to claim 8 wherein said housing comprises first and second housing portions, and wherein said first and second housing portions define respective, complimentary portions of the lengthwise extending aperture through which the fluid line extends.

11. An apparatus according to claim 10 further comprising at least one connector for interconnecting said first and second housing portions.

12. An apparatus according to claim 8 wherein said housing comprises beveled end portions for facilitating advancement of the percussion boring machine through the ground.

13. An apparatus for locating a percussion boring machine having a fluid line extending therefrom, the apparatus comprising:

a housing defining a receptacle therein, said housing comprising fastening means for mounting said housing to the fluid line such that the fluid line extends unbroken through at least a portion of said housing, said fastening means also mounting said housing to the fluid line such that said housing is maintained in a predetermined fixed relationship to the fluid line and to the percussion boring machine from which the fluid line extends; and a receiver, disposed within the receptacle defined by said housing, for receiving signals such that the location of the percussion boring machine can thereby be determined.

14. An apparatus according to claim 13 wherein said fastening means comprises a lengthwise extending aperture defined by said housing and through which the fluid line extends.

15. An apparatus according to claim 14 wherein said lengthwise extending aperture extends through a central portion of said housing, and wherein the receptacle is defined by a lateral portion of said housing.

16. An apparatus according to claim 14 wherein said housing comprises first and second housing portions, and wherein said first and second housing portions define respective, complimentary portions of the lengthwise extending aperture through which the fluid line extends.

17. An apparatus according to claim 16 further comprising at least one connector for interconnecting said first and second housing portions.

18. An apparatus according to claim 13 wherein said housing further comprises beveled end portions for facilitating advancement of the percussion boring machine through the ground.

19. A boring apparatus comprising:

percussion boring machine;

a fluid line extending from said percussion boring machine for supplying fluid thereto; and a locating device, mounted upon said fluid line, for providing signals indicative of a location of said percussion boring machine, said locating device comprising:

a housing defining a receptacle therein, said housing being mounted to said fluid line such that said fluid line extends unbroken therethrough and such that said housing remains in a predetermined fixed relationship to said fluid line and to said percussion boring machine during operation of said percussion boring machine; and a transmitter, disposed within the receptacle defined by said housing, for transmitting signals indicative of the location of said percussion boring machine.

20. A boring apparatus according to claim 10 wherein said housing further defines a lengthwise extending aperture for receiving said fluid line such that said fluid line extends unbroken therethrough.

* * * * *

UNITED STATES PATENT AND TRADEMARK OFFICE

CERTIFICATE OF CORRECTION

PATENT NO. : 5,692,576

DATED : December 2, 1997

INVENTOR(S) : Hesse et al.

It is certified that error appears in the above-identified patent and that said Letters Patent is hereby corrected as shown below:

Column 6, line 9, "claim 10" should be --claim 19--.

Signed and Sealed this

Fifth Day of May, 1998

Bruce Lehman

*Attest:*

BRUCE LEHMAN

*Attesting Officer*

*Commissioner of Patents and Trademarks*